US012085350B2

(12) United States Patent
Khan

(10) Patent No.: US 12,085,350 B2
(45) Date of Patent: Sep. 10, 2024

(54) SUPPRESSED REVOLVER WITH NOVEL SUPPRESSOR

(71) Applicant: Macksoud Khan, Palo Alto, CA (US)

(72) Inventor: Macksoud Khan, Palo Alto, CA (US)

( * ) Notice: Subject to any disclaimer, the term of this patent is extended or adjusted under 35 U.S.C. 154(b) by 125 days.

(21) Appl. No.: 18/097,220

(22) Filed: Jan. 14, 2023

(65) Prior Publication Data

US 2024/0240897 A1 Jul. 18, 2024

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/28; F41A 21/325; F41A 21/32
USPC ..... 89/14.3, 14.4, 181, 223
See application file for complete search history.

(56) References Cited

U.S. PATENT DOCUMENTS

| | | | | |
|---|---|---|---|---|
| 959,400 | A | 5/1910 | Stinson | |
| 1,017,003 | A | 2/1912 | Kenney | |
| 4,291,610 | A | 9/1981 | Waiser | |
| 5,136,924 | A | 8/1992 | Forster et al. | |
| 5,164,535 | A | 11/1992 | Leasure | |
| 7,987,944 | B1 | 8/2011 | Brittingham et al. | |
| 8,272,313 | B2 * | 9/2012 | Jebsen | F41A 3/56 89/190 |
| 8,839,709 | B1 | 9/2014 | Crye et al. | |
| 8,844,422 | B1 * | 9/2014 | Klett | F41A 21/34 89/14.4 |
| 8,875,612 | B1 * | 11/2014 | Klett | F41A 21/34 89/14.4 |
| 9,347,727 | B1 | 5/2016 | Cler | |
| 9,470,466 | B2 | 10/2016 | Washburn, III et al. | |
| 9,482,483 | B2 | 11/2016 | Whelan | |
| D778,389 | S | 2/2017 | Holden et al. | |
| 9,709,354 | B2 | 7/2017 | LaRue | |
| 9,835,400 | B2 | 12/2017 | Barrett et al. | |
| 9,851,166 | B2 | 12/2017 | Petersen | |
| 9,939,224 | B2 | 4/2018 | Steindl | |
| 10,018,440 | B2 | 7/2018 | Shults et al. | |
| D829,292 | S | 9/2018 | Ribelin et al. | |
| 10,082,354 | B1 * | 9/2018 | Lee | F41A 21/325 |
| 10,126,084 | B1 | 11/2018 | Oglesby | |
| 10,502,513 | B2 | 12/2019 | Ellison et al. | |
| 10,520,271 | B2 | 12/2019 | Barrett | |
| RE47,932 | E | 4/2020 | Young et al. | |
| 10,634,445 | B1 * | 4/2020 | Klett | F41A 21/30 |
| 11,092,398 | B2 | 8/2021 | Slack | |
| 11,105,577 | B1 | 8/2021 | Thomas et al. | |

(Continued)

OTHER PUBLICATIONS

Nagant M1895, Web, <https://en.wikipedia.org/wiki/Nagant_M1895>, retrieved Nov. 11, 2022.

(Continued)

*Primary Examiner* — Michael D David

(57) ABSTRACT

The present invention relates to a firearm with a frame, a trigger, a barrel entrance, a cam, and a revolving cylinder configured a gap distance from the barrel entrance. The firearm may have a suppressor with a bullet pathway that ends in a muzzle and a gas exit pathway that ends in a gas exit. The suppressor may have at least one resonant chamber. When the trigger of the firearm is pulled, the cam may contact the frame and the revolving cylinder to eliminate the gap distance. When a bullet is fired from the firearm, gas may follow a projectile portion of the bullet. The gas may expand within the suppressor. The at least one resonant chamber may bias the gas away from the muzzle. The gas may exit the firearm via a muzzle or via a gas exit.

20 Claims, 6 Drawing Sheets

(56) References Cited

U.S. PATENT DOCUMENTS

| | | | | |
|---|---|---|---|---|
| 11,359,879 | B2 | 6/2022 | Bray | |
| 11,713,936 | B1 * | 8/2023 | Lowell | F41A 21/325 89/14.4 |
| 2007/0107590 | A1 | 5/2007 | Silvers | |
| 2017/0102202 | A1 | 4/2017 | Augustine et al. | |
| 2019/0195589 | A1 * | 6/2019 | Lee | F41A 21/30 |

OTHER PUBLICATIONS

How a Nagant M1895 works, Web, <https://www.youtube.com/watch?v=aP13NZ4Yu48>, retrieved Nov. 11, 2022.

A Suppressed Revolver That's Not a Nagant : OTs-38, Web, <https://www.breachbangclear.com/stechkin-suppressed-revolver/>, retrieved Nov. 11, 2022.

Knight's Armament Company (KAC) Silenced Revolver Rifle, Web, <http://www.mythicarmory.com/kac-silenced-revolver-rifle.html#:~:text=The%20Knight's%20Armament%20Company%20(KAC,telescoping%22%20ammunition%20contained%20within%20a%20>, retrieved Nov. 11, 2022.

Peters PSDR III suppressed / silenced revolver (Germany / USA), Web, <https://modernfirearms.net/en/handguns/psdr-suppressed-silenced-iii-2/>.

U.S. Commandos Hunted the Viet Cong With Silent Revolvers, Web, <https://medium.com/war-is-boring/u-s-commandos-hunted-the-viet-cong-with-silent-revolvers-8f6cc5cfc731>, retrieved Nov. 11, 2022.

* cited by examiner

SUPPRESSED REVOLVER WITH NOVEL SUPPRESSOR

BACKGROUND OF THE INVENTION

The present invention relates to firearms, specifically firearms where bullets are housed in a revolving cylinder. These types of firearms are referred to as "revolvers". In the field of firearms, particular in the specific field of small arms commonly referred to as "handguns" or "pistols," there are two common types of firearms defined by the mechanism used to chamber and cycle rounds. Said types are commonly referred to as the semi-automatic firearm and the revolver.

As understood by one skilled in the art, a semi-automatic firearm discharges a spent bullet casing out of the side of the firearm and retrieves the next round by use of a spring located within the magazine of the firearm. Most semi-automatic firearms that exist in the art comprise a magazine in which bullets are stacked on top of one another and fed into the chamber of the firearm against the force of gravity.

Revolvers generally do not comprise a magazine to store bullets. Instead, revolvers comprise a cylinder with multiple chambers. After firing one bullet, the cylinder is rotated, generally by a mechanism, to align the next bullet with the hammer or firing pin. The spent bullet casings are not discharged from a revolver automatically.

The term "semi-automatic" shall be used in this description to describe the type of firearm commonly referred to as a semi-automatic firearm, which has been described previously herein. It is understood that some revolvers may function in a manner that may be considered "semi-automatic," in that bullets may be fired in rapid succession upon multiple pulls of the trigger, without cocking the firearm in between shots. However, one intent of this description is to differentiate between firearms that are revolvers and firearms that are not revolvers, and thus the term "semi-automatic" is used herein to describe firearms that function as semi-automatic firearms and that are not revolvers.

It is understood by those skilled in the art that firearms can emit a loud noise when fired, mainly due to pressurized gas leaving the barrel of the firearm after firing. For some firearm applications, such as covert military operations and sport shooting in highly populated areas, it is desirable to suppress this noise. This is achieved by use of a silencer, also referred to as a "suppressor", that acts as an additional volume at the end of the barrel of a firearm to allow gas to expand prior to exiting the firearm. This lowers the pressure of the escaping gas and thus lessens the noise emitted by the firearm.

Typically, suppressors are implemented on semi-automatic firearms. However, such implementation is counter-intuitive since semi-automatic firearms dispense a spent casing out of the firearm. Therefore, even if a suppressor is effective enough to completely silence the sound of gas escaping from a semi-automatic firearm, there will still be a noise emitted when the dispensed casing hits the ground, particularly if the firearm is fired in an environment with a stone or concrete floor. In a situation where complete silence is of the essence, the noise of a dispensed casing hitting the ground defeats the purpose of a suppressed firearm. Therefore, a revolver is a more practical firearm for a situation where silence is of the essence. However, revolvers are typically difficult to suppress since most revolvers are designed and built with a space between the cylinder and the barrel. This space exists to allow the cylinder to rotate with respect to the barrel, which must happen in order for the revolver to function as intended.

Most suppressors that exist in the art are essentially hollow cylinders that are attached to the end of the barrel of a firearm. Using this design, the only way to provide greater suppression is to add more volume, which means creating larger suppressors. This can become very inconvenient for the user of the firearm since larger suppressors can add weight to the firearm and block the user's field of vision between the sights of the firearm and the user's target. Furthermore, said suppressors that exist in the art are separate attachments to firearms, which presents an inconvenience to the user.

SUMMARY OF THE INVENTION

The present invention relates to a firearm with a handle end and a muzzle end. A handle may be configured at the handle end. A muzzle may be configured at the muzzle end. The firearm may have a frame that may form the overall shape of the firearm. The frame may enclose one or more of the various components of the firearm such as but not limited to a lift, cam, striking mechanism, firing pin, barrel tube, and suppressor. The firearm may be a handgun (also referred to as a "pistol"). The firearm may therefore be configured to be able to be held and fired with one hand. The firearm may also be held with two hands by gripping the handle with two hands.

The firearm may be a revolver, wherein bullets are housed within a revolving cylinder. The revolving cylinder may rotate about a revolving cylinder axis of rotation. The revolving cylinder may have a cylinder handle end and a cylinder muzzle end. The revolving cylinder may be configured a gap distance from a barrel entrance. The gap distance may be 1 mm or more, 2 mm or more, 3 mm or more, or any range between and including the distance values provided. The barrel entrance may be a point on the barrel of the firearm that is closest to the handle end of the firearm. The barrel of the firearm may be formed by the barrel tube and the suppressor. The barrel tube may be a cylindrical component that may be removable from the firearm. The barrel tube may have an exterior surface and an interior surface. The interior surface may have rifling, which is an arrangement of spiral grooves on the interior surface of the barrel tube. A bullet pathway may extend through the barrel and out the muzzle. Projectile portions of bullets may travel along the bullet pathway when they are fired from the firearm.

Bullets may be fired from the firearm when a trigger of the firearm is pulled, thereby causing the striking mechanism to strike the firing pin, thereby causing the firing pin to strike the bullet. The striking mechanism may be any striking mechanism known in the art of firearms, such as but not limited to a hammer which rotates about an axis of rotation, or a striker that translates laterally. The striking mechanism may be housed completely in the frame of the firearm. The firing pin may strike a primer of the bullet, which may cause a spark to ignite a fuel source of the bullet, which may cause a projectile portion of the bullet to travel along the bullet pathway and thereby be "fired from the firearm". The fuel source of the bullet may be contained within a bullet casing, which may remain in the revolving cylinder while the firearm is in use.

The bullets of the firearm may be standard .22 caliber bullets. "Caliber" is a standard sizing unit for bullets known in the art of firearms and ammunition. The bullets of the firearm may alternatively be any other standard caliber bullet known in the art of firearms and ammunition. The advantage of a standard .22 caliber bullet is that it is the smallest of the standard sizes of bullets, and therefore emits the least amount of noise when its fuel source is ignited and when it is fired from a firearm.

The cam may have a lift contact portion and a cam wedge. When the trigger of the firearm is pulled, the lift may engage with the lift contact portion of the cam. This may cause the cam to rotate about a cam axis of rotation. The cam axis of rotation may be parallel to the revolving cylinder axis of rotation. The cam axis of rotation may further be in-line with the revolving cylinder axis of rotation. The cam axis of rotation may alternatively be offset from the revolving cylinder axis of rotation by 0.5 mm or more, 1 mm or more, 1.5 mm or more, or any range between and including the offset values provided.

When the cam rotates about the cam axis of rotation, the cam wedge may contact the frame and the cylinder handle end of the revolving cylinder. This may cause the revolving cylinder to translate towards the muzzle end of the firearm, which may eliminate the gap distance. Therefore, when a bullet is fired from the firearm, gas that follows the projectile portion of the bullet may not be able to exit the firearm between the barrel and the revolving cylinder.

After the bullet is fired, the cam may rotate back to its original position about the cam axis of rotation, thereby increasing the gap distance to its original distance before the trigger was pulled. This may allow the revolving cylinder to rotate about the revolving cylinder axis of rotation in order to position another bullet with the firing pin.

The cam may rotate in one or more cam planes. Each of the one or more cam planes may be parallel to the muzzle. Each of the one or more cam planes may further be parallel to the cylinder handle end. The striking mechanism may not cross any of the one or more cam planes when the firearm is in use. This prevents the striking mechanism from interfering with the rotation of the cam.

The suppressor may be configured between the revolving cylinder and the muzzle end of the firearm. The suppressor may be enclosed within the frame. The suppressor may have a sight side and a trigger side. The sight side and trigger side of the suppressor may be on opposite sides of the bullet pathway. The sight side and trigger side of the suppressor may be parallel with one another, and may be perpendicular to both the muzzle end of the firearm and the handle end of the firearm.

At least one resonant chamber may be configured between the sight side and the trigger side of the suppressor. The at least one resonant chamber may have a resonant chamber handle end wall, a resonant chamber muzzle end wall, and a resonant chamber trigger side wall. The bullet pathway may extend through the at least one resonant chamber. The resonant chamber handle end wall and resonant chamber muzzle end wall may each have a concave curvature relative to the handle end of the firearm and a convex curvature relative to the muzzle end of the firearm. The resonant chamber trigger side wall may have a concave curvature relative to the sight side of the suppressor and a convex curvature relative to the trigger side of the suppressor. The resonant chamber handle end wall, resonant chamber muzzle end wall, and resonant chamber trigger side wall may each further have a complex curvature that has both concave and convex portions when viewed from the same face. The curvatures of the walls of the at least one resonant chamber may cause gas to be biased away from the muzzle of the firearm when gas expands within the at least one resonant chamber.

The resonant chamber handle end wall may have a resonant chamber handle end wall length. The resonant chamber muzzle end wall may have a resonant chamber muzzle end wall length. The resonant chamber trigger side wall may have a resonant chamber trigger side wall length. The resonant chamber handle end wall length may be greater than the resonant chamber trigger side wall length. The resonant chamber handle end wall length may be 1.5 times greater than the resonant chamber trigger side wall length. The resonant chamber handle end wall length may further be 2 times greater than the resonant chamber trigger side wall length. The resonant chamber muzzle end wall length may be less than or equal to the resonant chamber handle end wall length. The resonant chamber muzzle end wall length may be greater than the resonant chamber trigger side wall length. The resonant chamber handle end wall length, resonant chamber muzzle end wall length, and resonant chamber trigger side wall length may be measured as linear distances rather than along the curvatures of their respective walls.

One advantage of the proportions of the walls of the at least one resonant chamber includes allowing the majority of the volume of the at least one resonant chamber to be configured between the trigger side of the suppressor and the bullet pathway. This design allows the suppressor to not interfere with a line of sight of the firearm. Another advantage of the proportions of the walls of the at least one resonant chamber includes maximizing the volume of the at least one resonant chamber to allow for a greater volume in which gas may expand. Other advantages of the proportions of the walls of the at least one resonant chamber may exist that are not explicitly described herein.

The at least one resonant chamber may be a first resonant chamber and a second resonant chamber. The at least one resonant chamber may further be a first resonant chamber, a second resonant chamber, and a third resonant chamber. The at least one resonant chamber may be a first resonant chamber, a second resonant chamber, a third resonant chamber, and a fourth resonant chamber. The at least one resonant chamber may further be any number of resonant chambers greater than or equal to 1. In all embodiments, the first resonant chamber may be the resonant chamber that is configured closest to the handle end of the firearm. The at least one resonant chamber may be configured 10 mm or more from the trigger side of the suppressor. The at least one resonant chamber may further be configured 20 mm or more from the trigger side of the suppressor. The at least one resonant chamber may further be configured 30 mm or more from the trigger side of the suppressor.

The at least one resonant chamber may be configured a resonant chamber start distance from the barrel entrance. The resonant chamber start distance may be 20 mm or more, 40 mm or more, 60 mm or more, or any range between and including the distance values provided. In embodiments wherein the at least one resonant chamber is more than 1 resonant chamber, then the resonant chamber start distance may be the distance from the barrel entrance to the resonant chamber handle end wall of the first resonant chamber.

The at least one resonant chamber may have a resonant chamber volume. In embodiments with a first resonant chamber and a second resonant chamber, the first resonant chamber may have a first resonant chamber volume and the second resonant chamber may have a second resonant chamber volume. The first resonant chamber volume may be greater than the second resonant chamber volume. The first resonant chamber volume may be 3,000 $mm^3$ or more, 4,000 $mm^3$ or more, 5,000 $mm^3$ or more, or any range between and including the volume values provided. The second resonant chamber volume may be 2,500 $mm^3$ or more, 3,000 $mm^3$ or more, 3,500 $mm^3$ or more, or any range between and including the volume values provided.

When a bullet is fired from the firearm, gas may follow the projectile portion of the bullet. The gas may expand within the suppressor, and thereby reduce its speed, temperature, and pressure before exiting the firearm, thereby reducing the noise emitted by the firearm. The gas may expand within the suppressor along the resonant chamber start distance. Therefore, the gas may begin expanding within the suppressor before reaching the at least one resonant chamber. The gas may also expand within the at least one resonant chamber. The at least one resonant chamber may bias the gas away from the muzzle whereby the gas continues to expand within the suppressor before exiting through the muzzle, thereby allowing the gas to further reduce its speed, temperature, and pressure before exiting the firearm.

A gas exit pathway may be configured between the at least one resonant chamber and the trigger side of the suppressor. The gas exit pathway may terminate in a gas exit, which may exist as an opening in the firearm at the muzzle end. The gas exit may be configured between the muzzle of the firearm and the trigger side of the suppressor. Gas may travel through the gas exit pathway and exit the firearm through the gas exit rather. The gas may be allowed to expand within the gas exit pathway. The gas exit pathway may allow the gas more time to expand and therefore reduce its speed, temperature, and pressure before exiting the firearm. The gas may travel a distance of 100 mm or more through the gas exit pathway, 150 mm or more through the gas exit pathway, 200 mm or more through the gas exit pathway, or any range between and including the distance values provided.

The gas exit pathway may cause the gas to change its direction of travel at least once when traveling through the gas exit pathway. The gas exit pathway may cause the gas to travel 10 mm or more towards the handle end of the firearm before exiting through the gas exit. The gas exit pathway may further cause the gas to travel 20 mm or more towards the handle end of the firearm before exiting through the gas exit.

Since the suppressor may be enclosed within the frame of the firearm, the suppressor may not be detachable from the rest of the firearm. The suppressor may serve as the barrel of the firearm through which the bullet pathway extends. The suppressor may alternately serve as a portion of the barrel of the firearm, wherein the barrel tube serves as another portion of the barrel of the firearm. Gas that follows the projectile portion of the bullet through the suppressor may expand within the suppressor. Expansion of the gas within the suppressor may be aided by the at least one resonant chamber and the gas exit pathway. Expansion of the gas within the suppressor may cause the gas to reduce its speed, temperature, and pressure before exiting the firearm, thereby suppressing the sound emitted by the firearm when the gas exits the firearm. The gas may exit the firearm through the muzzle and the gas exit.

Though the firearm of the present invention is described as being a revolver, the suppressor of the firearm of the present invention may be implemented on a semi-automatic firearm as well. The suppressor may have the same design, features, dimensions, and benefits when implemented on a semi-automatic firearm as when implemented on a revolver. The suppressor may provide the same level of noise suppression when implemented on a semi-automatic firearm as when implemented on a revolver. Therefore, embodiments of the present invention may include the suppressor described herein implemented on a semi-automatic firearm rather than a revolver. A semi-automatic firearm may contain all of the components of the firearm described herein, with the exception of the revolving cylinder.

DETAILED DESCRIPTION

The description provided herein describes example embodiments of the present invention and is not intended to limit the invention to any particular embodiment, design, use, feature, component, shape, size, material, or any other property. Furthermore, the drawings provided herein show example embodiments of the present invention and are not intended to limit the invention to any particular embodiment, design, use, feature, component, shape, size, material, or any other property.

Figure 1:
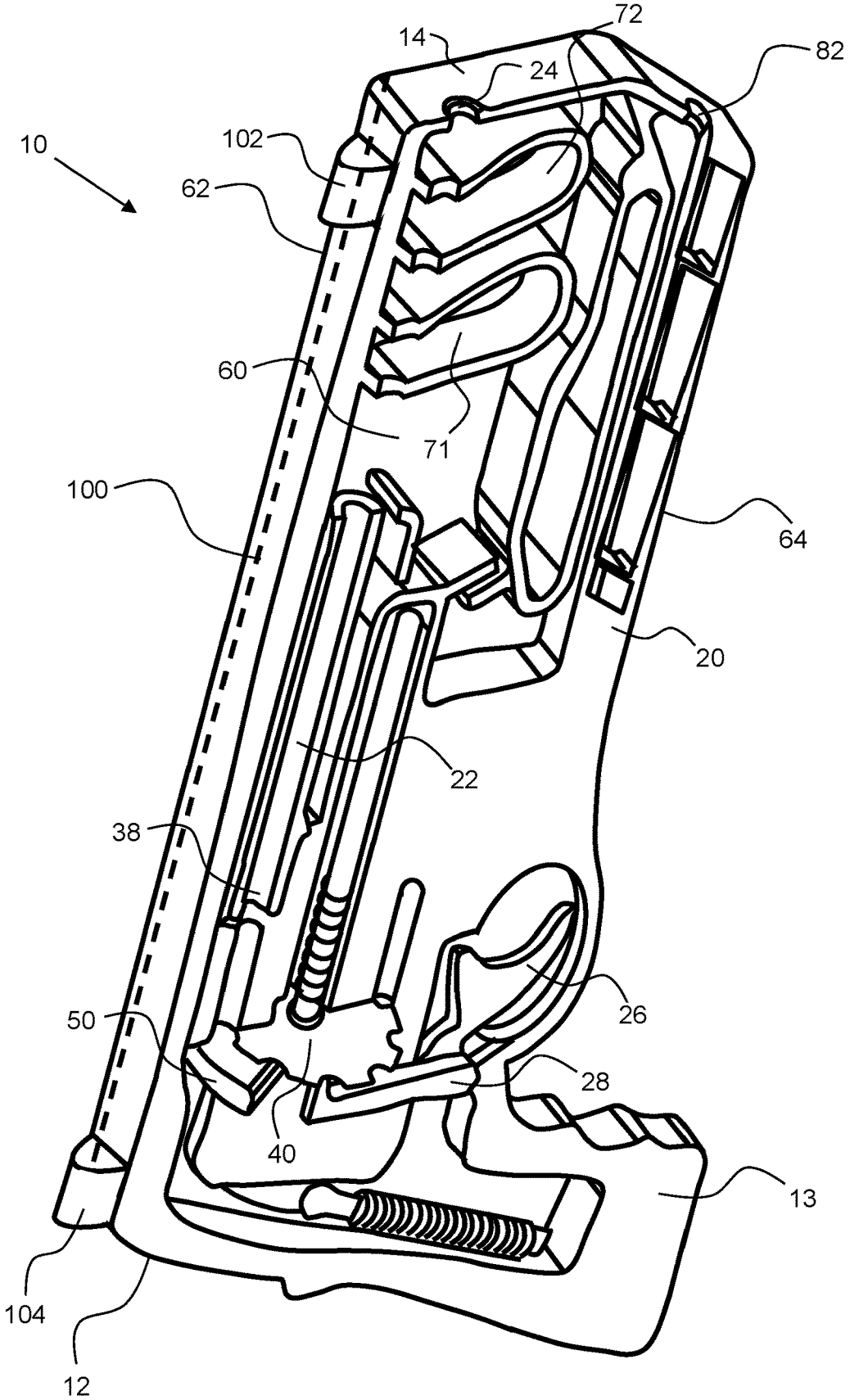
FIG. 1 is a front, right-side cross-sectional perspective view of a firearm according to some embodiments of the present invention. The broken line in FIG. 1 shows the line of sight of the firearm.

As shown in FIG. 1, a firearm 10 has a handle end 12 and a muzzle end 14. A handle 13 is configured at the handle end 12. A muzzle 24 is configured at the muzzle end 14. A gas exit 82 is also configured at the muzzle end 14. Various components of the firearm 10 such as but not limited to a lift 28, cam 50, and barrel tube 22 are configured within a frame 20 of the firearm 10. A suppressor 60 is configured near the muzzle end 14 of the firearm 10. The suppressor 60 has a sight side 62 and a trigger side 64. A first resonant chamber 71 and second resonant chamber 72 are configured near the sight side 62. A rear sight 104 is configured near the handle end 12 of the firearm 10 and a front sight 102 is configured near the muzzle end 14 of the firearm 10. A line of sight 100 extends from the rear sight 104 through the front sight 102 and beyond. The entirety of the suppressor 60 is configured on one side of the line of sight 100, and therefore the suppressor 60 does not interfere with the line of sight 100.

A trigger 26 extends from the firearm 10. When the trigger 26 is pressed, the lift 28 is actuated, which rotates a revolving cylinder 40 to position a bullet (not shown in FIG. 1) in front of a barrel entrance 38. As shown in FIG. 1, the barrel entrance 38 is configured at the end of the barrel tube 22 that is closest to the handle end 12 of the firearm 10.

When the firearm 10 is fired, a projectile portion of the bullet travels through the barrel tube 22, through the suppressor 60, and out the muzzle 24. Gas that follow the projectile portion of the bullet is allowed to expand within the suppressor 60 and is allowed to exit through the gas exit 82 in addition to the muzzle 24.

Figure 2:
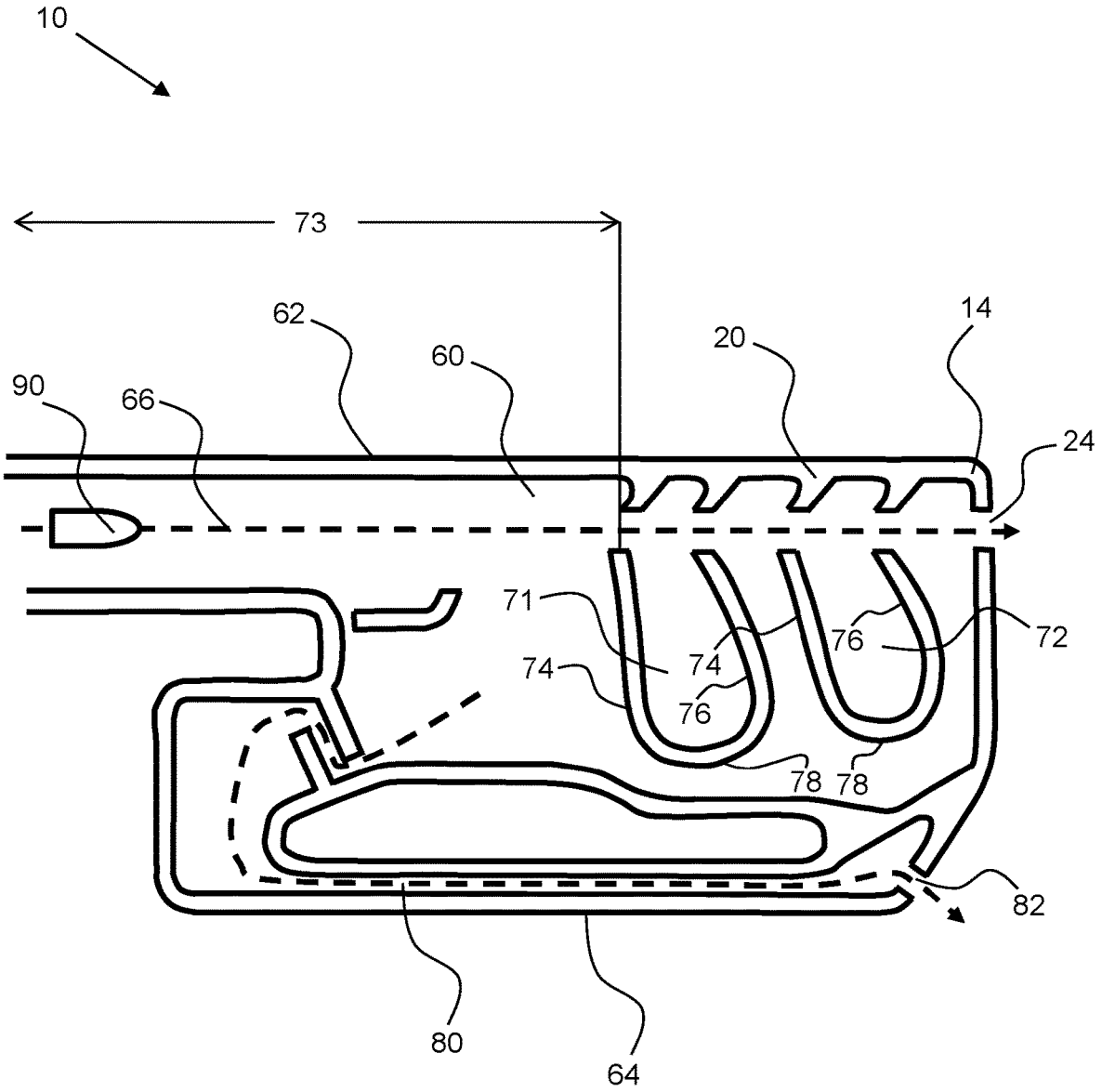
FIG. 2 is a right-side cross-sectional view of the suppressor of a firearm according to some embodiments of the present invention. The broken lines in FIG. 2 show the bullet pathway and the gas exit pathway.

As shown in FIG. 2, the suppressor 60 is configured near the muzzle end 14 of the firearm 10. The suppressor has a sight side 62 and a trigger side 64. The suppressor 60 is surrounded by the frame 20 of the firearm at the muzzle end 14, sight side 62, and trigger side 64. A first resonant chamber 71 and second resonant chamber 72 are configured within the suppressor 60. The first resonant chamber 71 is configured a resonant chamber start distance 73 from the barrel entrance (not shown in FIG. 2) of the firearm 10.

The first resonant chamber 71 has a resonant chamber handle end wall 74, a resonant chamber muzzle end wall 76, and a resonant chamber trigger side wall 78. The resonant chamber handle end wall 74 and the resonant chamber muzzle end wall 76 of the first resonant chamber 71 are shaped whereby they each have a concave curvature relative to the handle end of the firearm 10 and a convex curvature relative to the muzzle end 14 of the firearm 10. The resonant chamber trigger side wall 28 of the first resonant chamber 71 is shaped whereby it has a convex curvature relative to the trigger side 64 of the suppressor 60 and a concave curvature relative to the sight side 62 of the suppressor 60.

The second resonant chamber 72 is configured between the first resonant chamber 71 and the muzzle end 14 of the firearm 10. The second resonant chamber 72 has a resonant chamber handle end wall 74, a resonant chamber muzzle end wall 76, and a resonant chamber trigger side wall 78. The resonant chamber handle end wall 74 and the resonant chamber muzzle end wall 76 of the second resonant chamber 72 are shaped whereby they each have a concave curvature relative to the handle end of the firearm 10 and a convex curvature relative to the muzzle end 14 of the firearm 10. The resonant chamber trigger side wall 28 of the second resonant chamber 72 is shaped whereby it has a convex curvature relative to the trigger side 64 of the suppressor 60 and a concave curvature relative to the sight side 62 of the suppressor 60.

A bullet pathway 66 extends through the first resonant chamber 71 and the second resonant chamber 72. A projectile portion 90 of a bullet travels along the bullet pathway 66 as the projectile portion 90 of the bullet travels through the firearm 10 and out the muzzle 24. The majority of the volume of the first resonant chamber 71 is configured between the bullet pathway 66 and the trigger side 64 of the suppressor. The majority of the volume of the second resonant chamber 72 is also configured between the bullet pathway 66 and the trigger side 64 of the suppressor.

A gas exit pathway 80 is configured between the bullet pathway 66 and the trigger side 64 of the suppressor. The gas exit pathway 80 ends at the gas exit 82, which is configured at the muzzle end 14 of the firearm 10.

Figure 3:
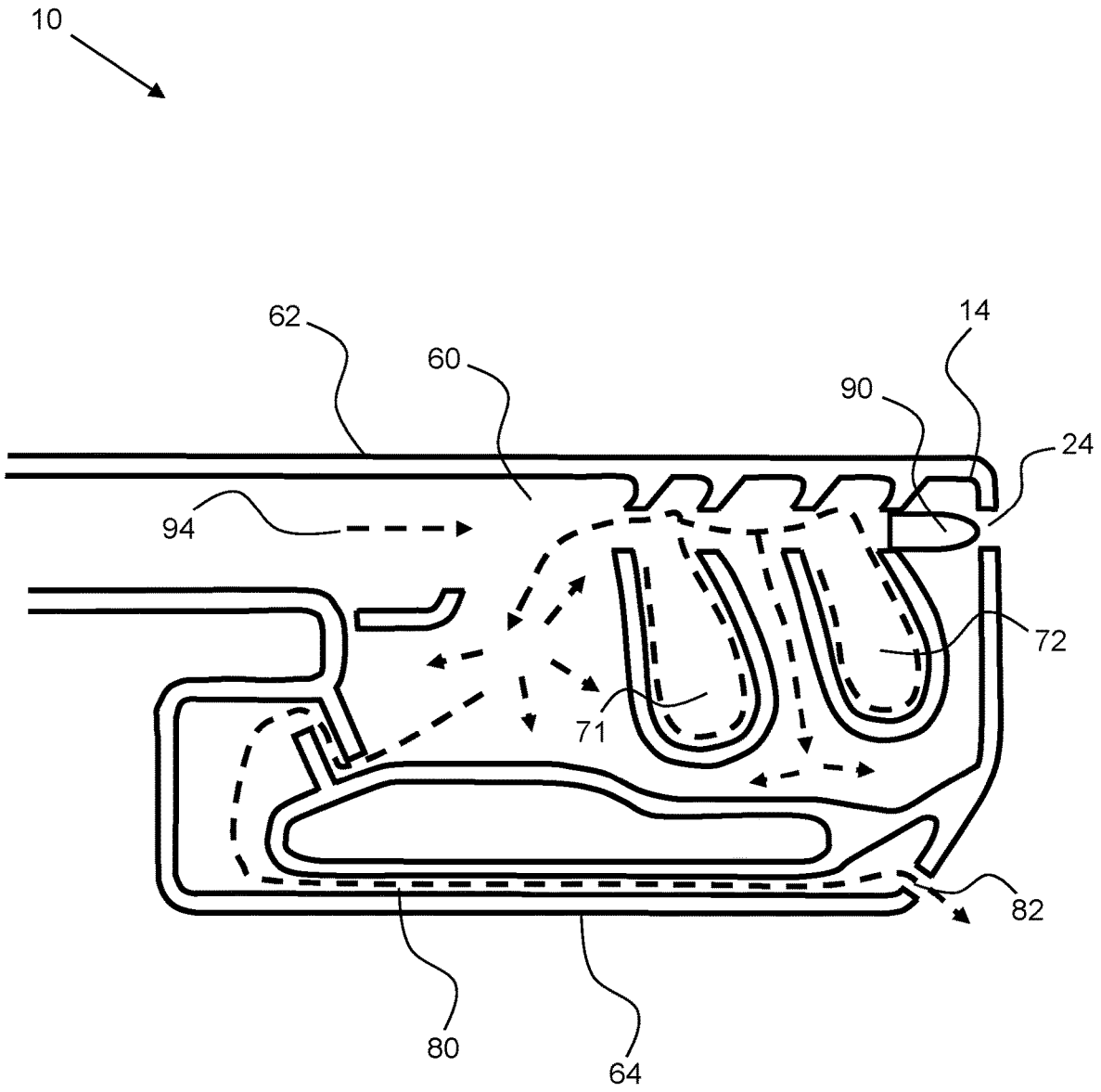
FIG. 3 is a right-side cross-sectional view of the suppressor of a firearm according to some embodiments of the present invention. The broken lines in FIG. 3 show gas expansion within the suppressor.

As shown in FIG. 3, gas (shown in FIG. 3 as broken lines and referenced with reference number 94) travels behind the projectile portion 90 of the bullet as the projectile portion 90 of the bullet travels through the firearm 10. The gas 94 is allowed to expand within the suppressor whereby the speed, temperature, and pressure of the gas 94 decreases. The decreased speed, temperature, and pressure of the gas 94 results in less noise emitted from the firearm 10 when the gas 94 eventually exits the firearm 10. The gas 94 may exit the firearm 10 through the muzzle 24 and gas exit 82.

As the gas 94 travels through the suppressor 60, some of the gas 94 expands within the first resonant chamber 71 and second resonant chamber 72. Due to the shapes of the first resonant chamber 71 and second resonant chamber 72, some of the gas 94 is re-directed away from the muzzle end 14 of the firearm 10. This forces the gas 94 to travel a greater distance before exiting the firearm 10, thereby allowing the gas 94 more time to decrease its speed, temperature, and pressure. The gas 94 may expand in multiple directions within the suppressor 60. Some of the gas 94 travels through the gas exit pathway 80 and out the gas exit 82. The muzzle 24 and gas exit 82 are the only two openings through which the gas 94 may exit the firearm 10. Therefore, gas 94 that does not exit through the muzzle 24 must exit through the gas exit 82. In order to exit through the gas exit 82, the gas must first travel along the gas exit pathway 80. The gas exit pathway 80 may add distance to the path that the gas 94 travels before exiting the firearm 10, thereby allowing the gas 94 more time to decrease its speed, temperature, and pressure, thereby reducing the noise that is emitted from the firearm 10 when the gas 94 exits the firearm 10.

Figure 4:
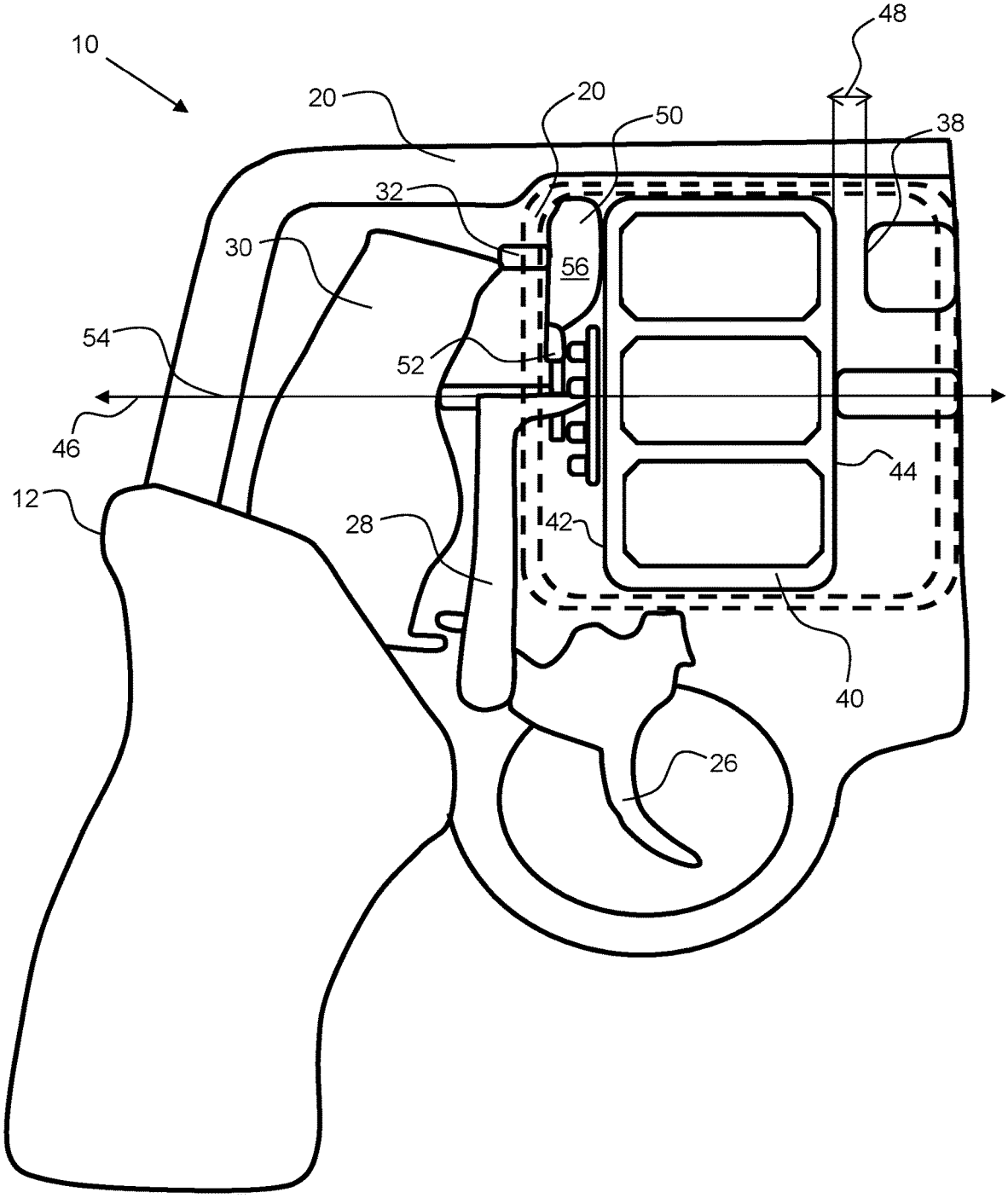
FIG. 4 is a right-side cross-sectional view of the handle end of a firearm according to some embodiments of the present invention. A portion of the frame of the firearm is shown in broken lines in FIG. 4 in order to show other components of the firearm that are hidden by the broken lines portion of the frame.

As shown in FIG. 4, the trigger 26 of the firearm 10 is coupled with a lift 28. When the trigger 26 is pressed, the lift 28 is actuated, which causes the revolving cylinder 40 to rotate about a revolving cylinder axis of rotation 46. The revolving cylinder 40 has a cylinder handle end 42 and a cylinder muzzle end 44. The cylinder handle end 42 is the end of the revolving cylinder 40 configured closest to the handle end 12 of the firearm 10. The cylinder muzzle end 44 is the end of the revolving cylinder 40 configured closest to the muzzle end of the firearm 10. Before the trigger 26 is pressed, the cylinder muzzle end 44 is configured a gap distance 48 from the barrel entrance 38.

Actuating the lift 28 also causes the lift 28 to contact a lift contact portion 52 of a cam 50, which causes the cam 50 to rotate about a cam axis of rotation 54. As shown in FIG. 4, the revolving cylinder axis of rotation 46 and the cam axis of rotation 54 are in-line with one another. When the cam 50 rotates about the cam axis of rotation 54, a cam wedge 56 of the cam 50 pushes between the frame 20 of the firearm 10 and the cylinder handle end 42 of the revolving cylinder 40. This causes the revolving cylinder 40 to be actuated towards the muzzle end of the firearm, thereby eliminating the gap distance 48. Eliminating the gap distance 48 prevents gas from exiting the firearm between the revolving cylinder 40 and barrel entrance 38 when the firearm 10 is fired. This forces the gas to travel through the suppressor, thereby reducing the noise emitted by the firearm 10.

Figure 5:
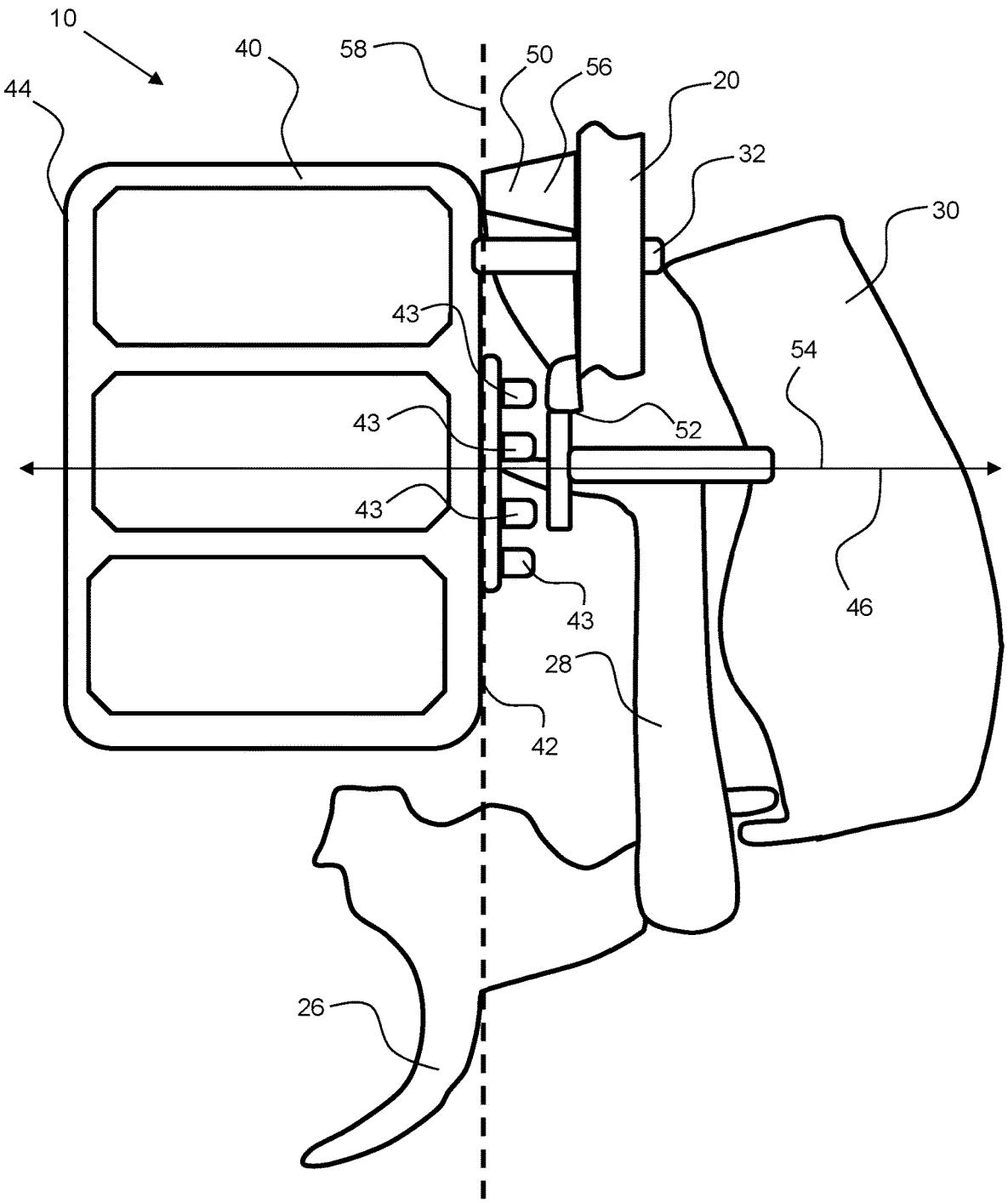
FIG. 5 is a left-side cross-sectional view of various components of a firearm according to some embodiments of the present invention before the trigger is pressed. The broken line in FIG. 5 shows a first cam plane.
Figure 6:
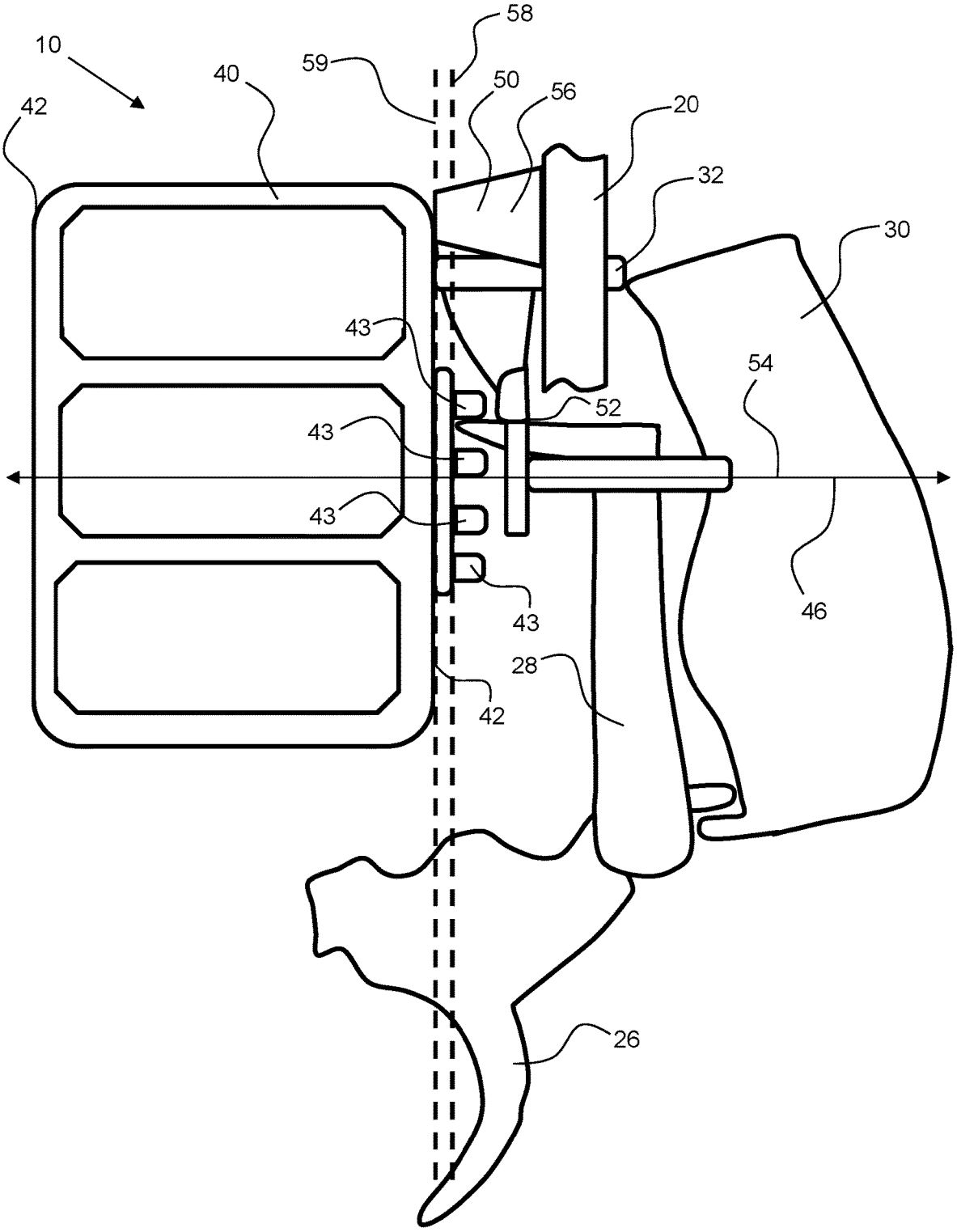
FIG. 6 is a lift-side cross-sectional view of various components of a firearm according to some embodiments of the present invention after the trigger is pressed. The broken lines in FIG. 6 show a first cam plane and a second cam plane.

As shown in FIG. 5, the cam 50 rotates about the cam axis of rotation 54 within a first cam plane 58. As shown in FIG. 6, after the trigger 26 is pressed, the cam 50 also rotates about the cam axis of rotation 54 in a second cam plane 59. The second cam plane 59 is configured further from the handle end of the firearm 10 than the first cam plane 58. The cam may also rotate within any number of other cam planes, which may be planes parallel to the muzzle of the firearm in which the cam 50 rotates.

As shown in FIG. 6, when the trigger 26 is pressed and the cam 50 rotates about the cam axis of rotation 54, the cam wedge 56 of the cam 50 pushes between the frame 20 of the firearm 10 and the cylinder handle end 42 of the revolving cylinder 40, causing the revolving cylinder 40 to be actuated towards the muzzle end of the firearm 10. The cam wedge 56 of the cam is configured around a firing pin 32 whereby the cam 50 does not interfere with the firing pin 32. When the trigger 26 is pressed, a striking mechanism 30 strikes the firing pin 32 which causes the bullet (not shown in FIG. 6)

to be fired. The striking mechanism 30 may not cross any of the cam planes. The striking mechanism 30 may always be configured between the cam planes and the handle end of the firearm 10.

As shown in FIGS. 5 and 6, revolving cylinder nubs 43 are configured at the cylinder handle end 42. When the trigger 26 is pressed, the lift 28 engages with one of the revolving cylinder nubs 43, which causes the revolving cylinder 40 to rotate about the revolving cylinder axis of rotation 46. This may occur simultaneously as the lift 28 engaging with the lift contact portion 52 of the cam 50. As the revolving cylinder 40 rotates about the revolving cylinder axis of rotation 46, a bullet (not shown in FIG. 5 or 6) contained within the revolving cylinder 40 may be aligned with the firing pin 32 so that the firing pin 32 may strike the bullet.

What is claimed is:

1. A firearm comprising:
a handle end;
a muzzle end;
a frame;
a trigger,
a lift;
a striking mechanism;
a firing pin;
a barrel entrance;
a revolving cylinder configured at a gap distance from the barrel entrance, the revolving cylinder comprising:
a cylinder handle end comprising revolving cylinder nubs;
a cylinder muzzle end;
a cam comprising:
a lift contact portion;
a cam axis of rotation;
a cam wedge;
a suppressor comprising:
a sight side;
a trigger side;
a bullet pathway configured between the sight side and the trigger side;
at least one resonant chamber configured between the sight side and the trigger side, the at least one resonant chamber comprising:
a resonant chamber handle end wall;
a resonant chamber muzzle end wall;
a resonant chamber trigger side wall;
a gas exit pathway configured between the at least one resonant chamber and the trigger side;
a muzzle configured at the muzzle end of the firearm; and
a gas exit configured at the muzzle end of the firearm;
wherein the suppressor forms at least a portion of a barrel of the firearm,
and wherein when the trigger is pressed, the lift engages the lift contact portion of the cam,
whereby the cam rotates about the cam axis of rotation,
whereby the cam wedge contacts the frame of the firearm and the cylinder handle end,
whereby the cylinder translates towards the suppressor,
whereby the gap distance between the cylinder and the barrel entrance is eliminated,
and wherein a bullet is configured within the rotating cylinder whereby when the trigger is pressed, the striking mechanism strikes the firing pin,
whereby the firing pin strikes the bullet,
whereby a projectile portion of the bullet travels through the suppressor and out the muzzle,
whereby gas follows the projectile portion of the bullet and is allowed to expand within the suppressor,
and wherein the gas exits the firearm through both the muzzle and the gas exit,
whereby the sound emitted from the gas exiting the firearm is suppressed by the suppressor.

2. The firearm of claim 1, wherein the bullet biases the gas towards the muzzle and wherein the at least one resonant chamber biases the gas away from the muzzle,
whereby the gas is directed away from the muzzle and is allowed to expand within the suppressor before exiting through the muzzle and the gas exit.

3. The firearm of claim 1, wherein the gas is allowed to expand within the at least one resonant chamber.

4. The firearm of claim 1, wherein the gas passes through the gas exit pathway before exiting through the gas exit,
whereby the gas is allowed to expand within the gas exit pathway.

5. The firearm of claim 4, wherein the gas travels a distance of 100 mm or more through the gas exit pathway.

6. The firearm of claim 4, wherein the gas travels a distance of 150 mm or more through the gas exit pathway.

7. The firearm of claim 4, wherein the gas exit pathway causes the gas to change directions while the gas travels through the gas exit pathway.

8. The firearm of claim 7, wherein the gas travels 10 mm or more towards the handle end of the firearm when the gas travels through the gas exit pathway.

9. The firearm of claim 1, wherein the trigger side wall of the at least one resonant chamber has a curvature.

10. The firearm of claim 1, wherein the at least one resonant chamber is configured 10 mm or more from the trigger side of the suppressor.

11. The firearm of claim 1, wherein the at least one resonant chamber is configured 20 mm or more from the trigger side of the suppressor.

12. The firearm of claim 1 wherein the at least one resonant chamber is a first resonant chamber and a second resonant chamber,
wherein the first resonant chamber is configured between the second resonant chamber and the handle end of the firearm.

13. The firearm of claim 12, wherein the first resonant chamber has a first resonant chamber volume,
and wherein the second resonant chamber has a second resonant chamber volume,
wherein the first resonant chamber volume is greater than the second resonant chamber volume.

14. The firearm of claim 13, wherein the first resonant chamber volume is 3,000 $mm^3$ or more.

15. The firearm of claim 13, wherein the first resonant chamber volume is 4,000 $mm^3$ or more.

16. The firearm of claim 1, wherein the at least one resonant chamber is configured a resonant chamber start distance from the barrel entrance,
whereby the gas is allowed to expand within the suppressor before reaching the at least one resonant chamber.

17. The firearm of claim 1, wherein the bullet pathway extends through the at least one resonant chamber.

18. The firearm of claim 1, wherein the cam rotates within one or more cam planes,
wherein the one or more cam planes are parallel to the muzzle,
and wherein the striking mechanism does not cross the one or more cam planes.

19. The firearm of claim 1, wherein the bullet is a standard .22 caliber bullet.

20. The firearm of claim 1, wherein when the lift engages the lift contact portion of the cam, the lift simultaneously engages one of the revolving cylinder nubs, whereby the revolving cylinder rotates about a revolving cylinder axis of rotation, whereby the bullet is aligned with the firing pin.

* * * * *